US006629580B2

(12) United States Patent
Nilsson et al.

(10) Patent No.: US 6,629,580 B2
(45) Date of Patent: Oct. 7, 2003

(54) PERFORATED END PIPE OF SILENCER UNIT

(75) Inventors: Ulf Nilsson, Hindås (SE); Pekka Saviharju, Ulricehamn (SE); Per-Ola Petersson, Göteborg (SE)

(73) Assignee: Volvo Personvagnar AB, Göteborg (SE)

( * ) Notice: Subject to any disclaimer, the term of this patent is extended or adjusted under 35 U.S.C. 154(b) by 0 days.

(21) Appl. No.: 09/895,029

(22) Filed: Jun. 30, 2001

(65) Prior Publication Data

US 2001/0045322 A1 Nov. 29, 2001

Related U.S. Application Data

(63) Continuation of application No. PCT/SE99/02437, filed on Dec. 21, 1999.

(30) Foreign Application Priority Data

Dec. 30, 1998 (SE) ..... 9804608

(51) Int. Cl.[7] ..... F01N 1/08
(52) U.S. Cl. ..... 181/265; 181/256; 181/272
(58) Field of Search ..... 181/256, 265, 181/266, 269, 272, 282, 239

(56) References Cited

U.S. PATENT DOCUMENTS 3,993,160 A 11/1976 Rauch
4,064,962 A * 12/1977 Hunt ..... 181/272
4,263,981 A 4/1981 Weiss et al.
4,359,135 A * 11/1982 Wagner et al. ..... 181/272
4,673,058 A 6/1987 Roberts et al.
5,025,890 A 6/1991 Hisashige et al.

FOREIGN PATENT DOCUMENTS

EP 0682172 A1 11/1995

* cited by examiner

*Primary Examiner*—Khanh Dang
(74) *Attorney, Agent, or Firm*—Howrey Simon Arnold & White LLP

(57) ABSTRACT

The invention relates to a device in a silencer unit of an automotive vehicle, for suppressing unwanted noise originating from an exhaust gas flow from the vehicle engine, said silencer unit being terminated by an end pipe, through which said exhaust gas flow is conveyed to the surroundings. The invention is characterized by the end pipe comprising at least one perforated section having a predetermined extension ($L_2$) in the longitudinal direction of the end pipe, and being positioned downstream of a point ($L_3$) along the end pipe where there is substantially no turbulence in the exhaust flow. Through the invention, an improved silencer unit is provided, with which predetermined requirements for comfort directed low-frequency suppression of the exhaust flow noise, as well as statutory requirements for high-frequency absorption of the noise, are fulfilled.

26 Claims, 1 Drawing Sheet

PERFORATED END PIPE OF SILENCER UNIT

CROSS REFERENCE TO RELATED APPLICATIONS

This is a continuation patent application of International Application Number PCT/SE99/02437 filed Dec. 21, 1999 that designates the United States. The full disclosure of said application, in its entirety, is hereby expressly incorporated by reference into the present application.

BACKGROUND OF INVENTION

Technical Field

The present invention relates to a device in a silencer unit. More particularly, the invention relates to a device for use with a silencer unit in an exhaust system of an automotive vehicle for suppressing unwanted noise originating from an exhaust gas flow through said exhaust system.

Background Information

An exhaust system is used for discharging an exhaust gas flow from a vehicle engine to the surroundings. Here, the term "exhaust system" is used to designate an arrangement comprising a number of tubular components that convey exhausts out of an exhaust manifold of the engine, a silencer unit, and, typically, a three-way catalytic converter. The silencer unit reduces unwanted noise originating from the exhaust gas flow through the exhaust system, whereas the three-way catalytic converter reduces the emission of harmful contaminants from the engine.

The above silencer unit functions evening out pulsation of the flowing exhaust gases, and making this pulsation as inaudible as possible. In order to enhance the comfort of the vehicle passengers, today's silencer units are designed to reduce noise from the exhaust gas flow to a level below a predetermined limit value. The "limit value" designates a varying value (or a set of values) depending on the frequency of the noise. Due to statutory requirements in various countries regarding the noise level that can be perceived outside the vehicle, i.e., that influences the vehicle's exterior environment, it is necessary to limit the noise level in order to meet these requirements.

Consequently, the exhaust system has to be designed in such a way as to meet both the comfort requirements as well as the statutory requirements with regard to acceptable noise levels.

Known silencer units are arranged as a termination of the exhaust system and comprises a chamber through which the exhaust gases are conveyed. The outlet from this chamber is a tubular end pipe through which exhaust gases flow. From the end pipe, the exhaust gases are passed into a further tubular member positioned in a conventional manner so as to extend from the tail end of the vehicle.

Present silencer units are preferably filled, completely or in part, with mineral wool or a similar sound-absorbing material. Furthermore, the end pipe may be perforated, i.e., provided with a number of relatively small holes, distributed along the circumferential surface of the end pipe. This allows the high-frequency energy in the exhaust gas flow to vent out to the surroundings and be absorbed by the sound-absorbing material, which preferably encompasses the end pipe perforations. This results in a reduction of the sound level from the exhaust gas flow, mainly at relatively high frequencies. A reduction of the noise at relatively low frequencies is achieved through a suitable sizing of the length and diameter of the end pipe.

The sound-absorbing properties of a silencer unit in a vehicle are determined by several factors, e.g., the type of engine, the flow properties of the exhaust gases, and the design and the dimensions of the exhaust system. Not least, the sound-absorbing properties are influenced to a high degree by the configuration of the passenger compartment of the vehicle in question. In some vehicles, the geometry and dimensions of the passenger compartment contribute to a relatively high noise level at relatively low frequencies, particularly in the order of about 50 to about 70 Hz, due to stationary wave conditions and resonance inside the compartment. This type of low-frequency noise is very unfavorable from a comfort aspect and constitutes a problem when exceeding acceptable noise level limits.

The problem of excessively loud low-frequency noise may be resolved by utilizing a relatively long end pipe that is not equipped with perforations. This would then mean that the low-frequency noise could be reduced to a level that would be acceptable from a comfort aspect, while simultaneously having the effect of substantially reducing the absorption of high-frequency noise. There would then arise a risk of the noise absorption in relatively high frequencies, particularly in the order of about 150 to about 200 Hz, being unsatisfactory. In worst cases, this could lead to not being able to meet statutory requirements regarding exterior, high-frequency noise from the vehicle.

Consequently, there are contradictory requirements regarding the object of striving to suppress the low-frequency noise while at the same time meeting statutory requirements regarding the levels of the exterior high-frequency noise. An exhaust system having an increased volume might solve this problem. However, this is not always possible, as the exhaust system has to be sized and designed to meet those requirements regarding its mounting space in the vehicle, as well as its cost, weight and similar factors.

U.S. Pat. No. 4,673,058 teaches an automotive muffler having a low frequency tuning chamber and a high frequency tuning chamber, the latter being packed with a sound absorbing material.

U.S. Pat. No. 5,025,890 teaches an engine exhaust apparatus having two outlet pipes, and which is arranged so as to lower the level of high frequency noise and also create non-offensive, comfortable and sporty sounds, especially in a low or intermediate frequency region.

Furthermore, U.S. Pat. No. 3,393,160 teaches a silencer provided with an outlet tube having a series of orifices.

SUMMARY OF INVENTION

The present invention provides an improved device for a silencer unit of an automotive vehicle, which, for reasons of comfort, provides a high degree of damping of low-frequency noise while at the same time, in response to existing statutory requirements, provides a high absorption of high-frequency noise.

The invention constitutes a device for a silencer unit of an automotive vehicle for suppressing unwanted noise originating from an exhaust gas flow from the vehicle engine. According to the invention, the silencer unit is terminated by an end pipe through which exhaust gas flow is conveyed to the surroundings. The end pipe has at least one perforated section with a predetermined extension in the longitudinal direction of the end pipe positioned downstream of a point along the end pipe where there will be substantially no turbulence in the exhaust flow. Through the invention, a high suppression of low-frequency noise as well as a good absorption of high-frequency noise is achieved. A further advantage of the invention is that it provides a passive silencing system that is simple, robust and cost-effective. According to the prior art, there is generally a maximum allowable length for an end pipe. If the end pipe is made too long (which might be required for suppressing low-frequency noise), there is a risk of resonance occurring. This may lead to audible tones being generated, which would be undesirable. However, according to the present invention this maximum length can be exceeded without creating unwanted tones, which is a further advantage of the invention.

Other advantageous embodiments are disclosed herein below.

DETAILED DESCRIPTION

Figure 1:
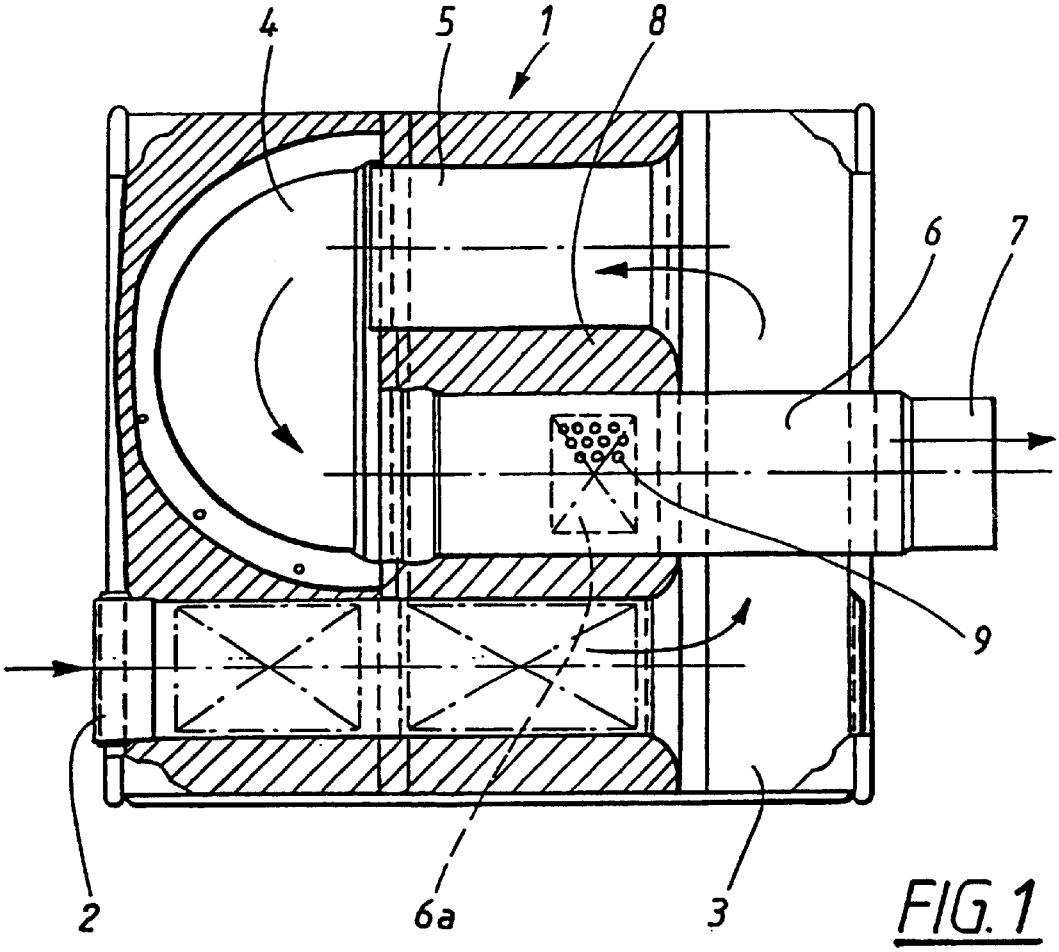
FIG. 1 illustrates a partial, cross-sectional side view of a silencer unit in which the present invention could be utilized.

FIG. 1 shows a partial, cross-sectional side view, of a silencer unit 1 according to the present invention. According to a preferred embodiment, the silencer unit 1 is used in an automotive vehicle, preferably of a passenger car. The silencer unit 1 functions to convey exhaust gas flow from a combustion engine (not shown) of the vehicle to the vehicle's surroundings. The silencer unit 1 is configured with an inlet 2 through which the exhaust gases flow from the engine. From the inlet 2, the exhaust is conveyed to a chamber 3 and on to a bend 4 via a straight tubular section 5. The flow direction of the exhaust is indicated by arrows in FIG. 1.

The bend 4 leads to an end pipe 6, preferably being cylindrical and straight, and extending through the chamber 3. From the end pipe 6 the exhaust gases are conveyed to the surroundings, preferably via a further pipe section 7 mounted on the end pipe 6 and positioned to discharge the gases at the rear end of the vehicle. The end pipe 6 together with the further pipe section 7 thus defines a substantially straight, tubular termination of the present exhaust system.

According to the embodiment, the end pipe 6 is, at least partially, surrounded by a sound-absorbing material 8, preferably in the form of mineral wool or a similar sound absorbent. However, the invention is not limited to this embodiment, but may also be configured with the end pipe 6 surrounded by air.

As described in detail below, the end pipe 6 is configured with a perforated section 6*a*. This section is provided with a large number of relatively small holes 9 made along a portion of the circumferential surface of the end pipe 6. The perforated section 6*a* extends along a predetermined portion of the total length of the end pipe 6. As configured the silencer unit 1 is able to suppress unwanted noise that occurs from exhaust gas flow through the exhaust system. In this context it should be noted that the invention achieves a high suppression of low-frequency noise by adapting the lengths of the end pipe 6 and of the perforated section 6*a*, respectively, while at the same time obtaining a high absorption of high-frequency noise through the perforated section 6*a*. As a consequence, silencing is achieved over a wide range of frequencies.

Figure 2:
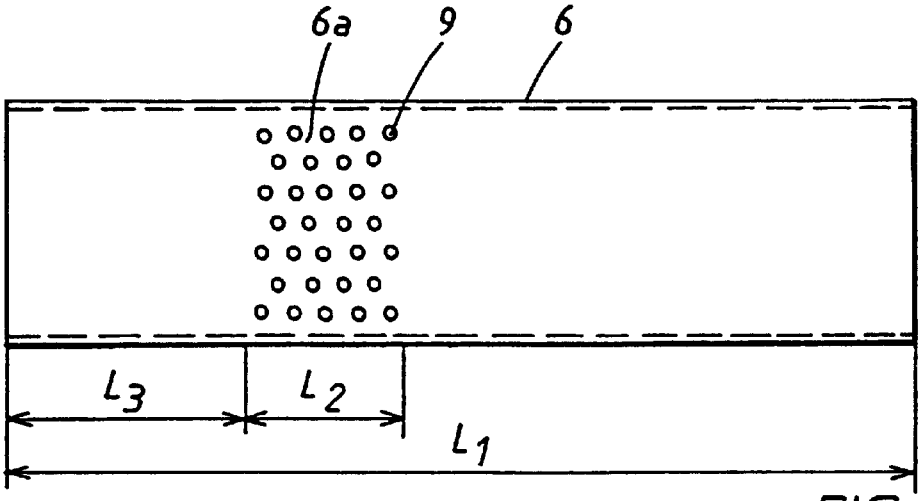
FIG. 2 illustrates a side view of an end pipe configured according to the present invention.

FIG. 2 illustrates a somewhat enlarged side view of the end pipe 6. From FIG. 2 it is seen that the end pipe 6 has a predetermined total length $L_1$. This total length $L_1$ may be defined from the point where it is connected to the bend 4 (see FIG. 1) up to the further pipe section 7 terminating the exhaust system. The length $L_1$ is selected based upon the type of vehicle and type of engine in question, in order to provide a high suppression of relatively low frequency noise from the exhaust gas flow.

The perforated section 6*a* may be designed with an extension or length $L_2$ in the longitudinal direction of the end pipe 6 representing a predetermined portion of the total length $L_1$ of the end pipe 6. Furthermore, the perforation preferably extends around the entire circumference of the end pipe 6. The perforated section 6*a* is further located so as to extend from a point along the end pipe 6, positioned at a predetermined distance $L_3$ from the connection of the end pipe 5 to the bend 4, i.e., measured from the upstream end portion of the end pipe 6. The last-mentioned distance $L_3$ preferably corresponds to that distance between the upstream end portion and that downstream point along the end pipe 6. This distance is the distance at which turbulent flow created by bent pipe sections, deflections and area changes inside the silencer unit 1 existing in the exhaust gases through the bend 4 has substantially ceased and been transformed to a non-turbulent flow in the end pipe 6.

In a normal application, the length $L_1$ of the end pipe 6 may be in the order of about 250 to about 300 mm, whereas the distance $L_3$ between the connection of the end pipe 6 to the bend 4 and the perforated section 6*a* according to the invention may be in the order of about 70to about 100 mm. However, variations may occur within the scope of the invention, depending on the type of engine, flow conditions of the exhaust gases, and similar factors. However, a basic principle of the invention is that the last-mentioned distance $L_3$ is selected so that there will be substantially no turbulent flow in the end pipe 6 at that point from which the perforated section 6*a* has its extension.

Preferably, the holes 9 are arranged in a regular pattern as shown in FIG. 2, and are configured so that each hole 9 has a diameter selected whereby the high-frequency energy from the exhaust gas flow is vented out and converted to heat by friction against the absorbing material 8 surrounding the perforated section 6*a*. In this way, an efficient absorption of high-frequency noise is achieved. In a normal application, the size of the hole 9 is preferably in the order of about 3 to about 5 mm, most preferably about 3.5 mm. The spacing between two adjacent holes is preferably in the order of about 3 to about 8 mm, most preferably about 5 to about 6 mm.

As discussed above, the length $L_2$ of the perforated section 6*a* of the end pipe 6 corresponds to a predetermined portion of the total length $L_1$ of the end pipe 6. More particularly, the length $L_2$ of the perforated section 6*a* is sized to balance the requirement for suppression at relatively low frequencies and the requirement for suppression at relatively high frequencies. The longer the perforated section 6*a* is made, the worse the low-frequency suppression will be, and the shorter it is made, the worse the high-frequency absorption will be. The value of the length $L_2$ is selected based on a value corresponding to fulfilling predetermined requirements for comfort-directed low-frequency suppression as well as statutory requirements for high-frequency absorption.

In a preferred embodiment, the length $L_2$ of the perforated section 6*a* is selected at about 10 to about 20% of the total length $L_1$ of the end pipe 6. In a normal application, where the length of the end pipe 6 is in the order of about 250 to about 300 mm, the length $L_2$ of the perforated section 6*a* would be in the order of about 25 to about 60 mm, preferably about 35 to about 45 mm.

Other embodiments of the invention are conceivable. For example, the invention may in principle be utilized in passenger cars, buses and load-carrying vehicles. Further, the dimensions of the end pipe 6 and the rest of the silencer unit 1 may vary since they are influenced by various factors such as engine type, calculated mass flow of the exhaust, and available mounting space. In general, it may be stated that the diameter of the end pipe 6 must be sufficiently large to allow the expected mass flow of exhaust gases from the engine in question. Further, the cross section of the end pipe 6 could be circular or alternatively oval, or of another suitable shape.

The invention is not limited to the type of silencer unit shown in FIG. 1, but can be utilized in other configurations and types of silencers. Furthermore, the perforated section can be positioned around the entire circumferential surface of the end pipe, or alternatively along a portion of said circumferential surface.

According to another embodiment, the end pipe may be configured with two or more smaller, perforated sections instead of one larger, perforated section. Also the total length or extension of the perforated sections may be selected to a value corresponding to fulfilling predetermined limit values regarding suppression at relatively low frequencies and relatively high frequencies of the noise from the exhaust flow.

Although the present invention has been described and illustrated in detail, it is to be clearly understood that the same is by way of illustration and example only, and is not to be taken as a limitation. The spirit and scope of the present invention are to be limited only by the terms of any claims presented hereafter.

What is claimed is:

1. A device in a silencer unit of a vehicle for suppressing unwanted noise originating from an exhaust gas flow from a vehicle engine, said silencer unit comprising:

an end pipe at one end of said silencer unit through which said exhaust gas flow is conveyed to the surroundings, said end pipe further comprising at least one perforated section wherein said perforated section has a predetermined extension in a longitudinal direction of said end pipe and is positioned downstream of a point along the end pipe where there is substantially no turbulence in the exhaust flow, and wherein said perforated section has a length amounting to a portion of the total length of said end pipe and corresponding to a value at which predetermined limit values regarding suppression at relatively low frequencies and relatively high frequencies of said noise are satisfied.

2. The device according to claim 1 wherein said length of said perforated section is about 10% to about 20% of the total length of said end pipe.

3. The device according to claim 1, said perforated section further comprising a multitude of manufactured holes having a diameter in the order of about 3 mm to about 5 mm and being arranged with a reciprocal spacing between adjacent holes in the order of about 3 mm to about 8 mm.

4. A vehicle comprising the device according to claim 1.

5. An end pipe for a silencer unit of an automotive vehicle for suppressing noise originating from an exhaust gas flow from the vehicle engine, comprising:

at least one perforated section having a predetermined extension in the longitudinal direction of the end pipe and being positioned downstream of a point along the end pipe where substantially no turbulent exhaust flow through the end pipe can be expected, said perforated section having a length amounting to a portion of the total length of said end pipe and corresponding to a value at which predetermined limit values regarding suppression at relatively low frequencies and relatively high frequencies of said noise are satisfied.

6. The device according to claim 1 wherein an arcuate tubular section connects a straight tubular section, positioned upstream said arcuate tubular section, to said end pipe.

7. The device according to claim 1 wherein said perforated section extends along a portion of the circumferential surface of the end pipe.

8. The device according to claim 1 wherein said total length of said end pipe measures about 250 mm to about 300 mm.

9. The device according to claim 1 wherein said length of said perforated section is about 25 mm to about 60 mm.

10. The device according to claim 1 wherein said length of said perforated section is about 35 mm to about 45 mm.

11. The device according to claim 1 wherein said perforated section is positioned about 70 mm to about 100 mm along said end pipe as measured from an upstream end of said end pipe.

12. The end pipe according to claim 5 wherein said length of said perforated section is about 10% to about 20% of the total length of said end pipe.

13. The end pipe according to claim 5 wherein said total length of said end pipe measures about 250 mm to about 300 mm.

14. The end pipe according to claim 5 wherein said length of said perforated section is about 25 mm to about 60 mm.

15. The end pipe according to claim 5 wherein said length of said perforated section is about 35 mm to about 45 mm.

16. The end pipe according to claim 5 wherein said perforated section is positioned about 70 mm to about 100 mm along said end pipe as measured from an upstream end of said end pipe.

17. A method for providing a silencer unit of a vehicle adapted for suppressing unwanted noise originating from an exhaust gas flow from a vehicle engine, said method comprising:

providing an end pipe at one end of said silencer unit through which said exhaust gas flow is conveyed to the surroundings, said end pipe further provided with at least one perforated section wherein said perforated section has a predetermined extension in a longitudinal direction of said end pipe and positioning said perforated section downstream of a point along the end pipe where there is substantially no turbulence in the exhaust flow, and configuring said perforated section to have a length amounting to a portion of the total length of said end pipe to cause noise originating from an exhaust gas flow from a vehicle engine passing through said perforated section to correspond to predetermined limit values regarding suppression at relatively low frequencies and relatively high frequencies.

18. The method according to claim 17 further comprising configuring said length of said perforated section to be about 10% to about 20% of the total length of said end pipe.

19. The method according to claim 17 further comprising configuring said perforated section to have a multitude of manufactured holes having a diameter in the order of about 3 mm to about 5 mm and being arranged with a reciprocal spacing between adjacent holes in the order of about 3 mm to about 8 mm.

20. The method according to claim 17 further comprising configuring an arcuate tubular section to connect a straight tubular section, positioned upstream of said arcuate tubular section, to said end pipe.

21. The method according to claim 17 further comprising configuring said perforated section to extend along a portion of the circumferential surface of the end pipe.

22. The method according to claim 17 further comprising configuring said total length of said end pipe to measure about 250 mm to about 300 mm.

23. The method according to claim 17 further comprising configuring said length of said perforated section to be about 25 mm to about 60 mm.

24. The method according to claim 17 further comprising configuring said length of said perforated section to be about 35 mm to about 45 mm.

25. The method according to claim 17 further comprising configuring said perforated section to be positioned about 70 mm to about 100 mm along said end pipe as measured from an upstream end of said end pipe.

26. The method according to claim 17 further comprising configuring said length of said perforated section to be about 10% to about 20% of the total length of said end pipe.

* * * * *